United States Patent [19]

Johansson

[11] 4,371,287

[45] Feb. 1, 1983

[54] SURFACE TROWELLING DEVICE

[76] Inventor: Leif Johansson, Bäckvägen 15, Kallered, Sweden, 430 50

[21] Appl. No.: 160,489

[22] Filed: Jun. 18, 1980

[51] Int. Cl.[3] ..... E01C 19/00

[52] U.S. Cl. ..... 404/84; 404/112; 404/114

[58] Field of Search ..... 404/112, 84, 118

[56] References Cited

U.S. PATENT DOCUMENTS

| | | | |
|---|---|---|---|
| 2,796,685 | 6/1957 | Bensinger | 404/84 |
| 2,916,836 | 12/1959 | Stewart et al. | 404/84 |
| 3,071,049 | 1/1963 | Pizzarotti et al. | 404/84 |

FOREIGN PATENT DOCUMENTS

| | | | |
|---|---|---|---|
| 2733419 | 1/1979 | Fed. Rep. of Germany | 404/112 |

*Primary Examiner*—Nile C. Byers, Jr.
*Assistant Examiner*—Roberto L. Calderon
*Attorney, Agent, or Firm*—Cantor and Singer

[57] ABSTRACT

For trowelling concrete spread over a floor, a trowelling device is used, which includes a carrier having a cantilever arm swingable over the floor. At the distal end of the arm a rotatable trowelling member is carried in a pedestal structure permitting vertical adjustment of the floor contacting parts. A laser sends a horizontal beam at a predetermined level over the floor, and an upwardly directed measuring rod at the housing of the trowelling member is provided with a detector for catching the beam, and for transferring deviations of the beam from a mark thereon into signals for adjusting the position of the trowelling member.

8 Claims, 6 Drawing Figures

SURFACE TROWELLING DEVICE

BACKGROUND OF THE INVENTION

The present invention refers to a device for screeding or trowelling a filling compound, especially concrete, and comprises a rotatable trowelling member, which is displaceable in the horizontal plane. When working with concrete, for instance when casting floors in buildings, and covering surfaces of roads and viaducts, it is desirable to be able to work a large area in a single operation, so requirements concerning strength and level finish within prescribed tolerances are fulfilled.

Conventional technique includes poker vibration of the compound, and then surface vibrations to obtain a smoothness of the surface. A surface vibrating apparatus usually comprises a frame carrying vibrator means, and having two spaced long scraper blades, which trowel the concrete surface. The frame is carried by rails and is mostly operated manually.

The rails may be formedby edge portions of the formwork, or by pipes resting upon specially erected supports, and must be carefully weighed out.

Trowelling of smaller surfaces is often made by means of manually operated machines, which instead of blades are provided with a rotatable disc. Such a machine is carried by the disc resting on the concrete, and it is necessary that the concrete has set to some degree before the operation starts. Also here the edge portions of the formwork must be carefully weighed out, as they are the only references available to the operator, which must have a high degree of skill and experience, so the surface become absolutely flat without "dips".

SUMMARY OF THE INVENTION

The aim of the present invention is to eliminate the tedious work of erecting and weighing out the edge portions of the formwork, or separate rails, respectively, and also to reduce the costs for providing, maintaining and storing such components. A further aim is to substitute the multitude of dimensions at frames and scraper blades, which is now required, with a few sizes of the device according to the invention. A further advantage is that the operation will not require any high skill of the operator, which furthermore can alone perform the work requiring five to six men at a conventional surface vibrator trowelling equipment.

A device according to the invention comprises a carrier, mountable outside the surface and having a cantilever arm extendible over the surface, a vertical pedestal at the distal end of said cantilever arm for carrying the trowelling means, which includes a compound distributor, rotatable about the pedestal, a mechanism for adjusting the distributor vertically with respect to the pedestal, a measuring rod extending upwardly from the trowelling means, and carrying a receiver for the beam issued by a photodetector and means for transferring changes in the relative position between the receiver at the measuring rod and the photo-detector beam to signals governing the adjusting mechanism. The rotatable trowelling means may comprise a ring carried by spokes from a hub, and mounting a number of substantially radially directed scraper blades, but may also be formed as a housing comprising a number of radially directed shovels, each having a roof part and a peripheral wall, said side wall being so arranged that the radial distance (r) from the pedestal axis to the side wall decreases in the direction of rotation, counting from the leading edge.

DESCRIPTION OF SOME PREFERRED EMBODIMENTS

Figure 1:
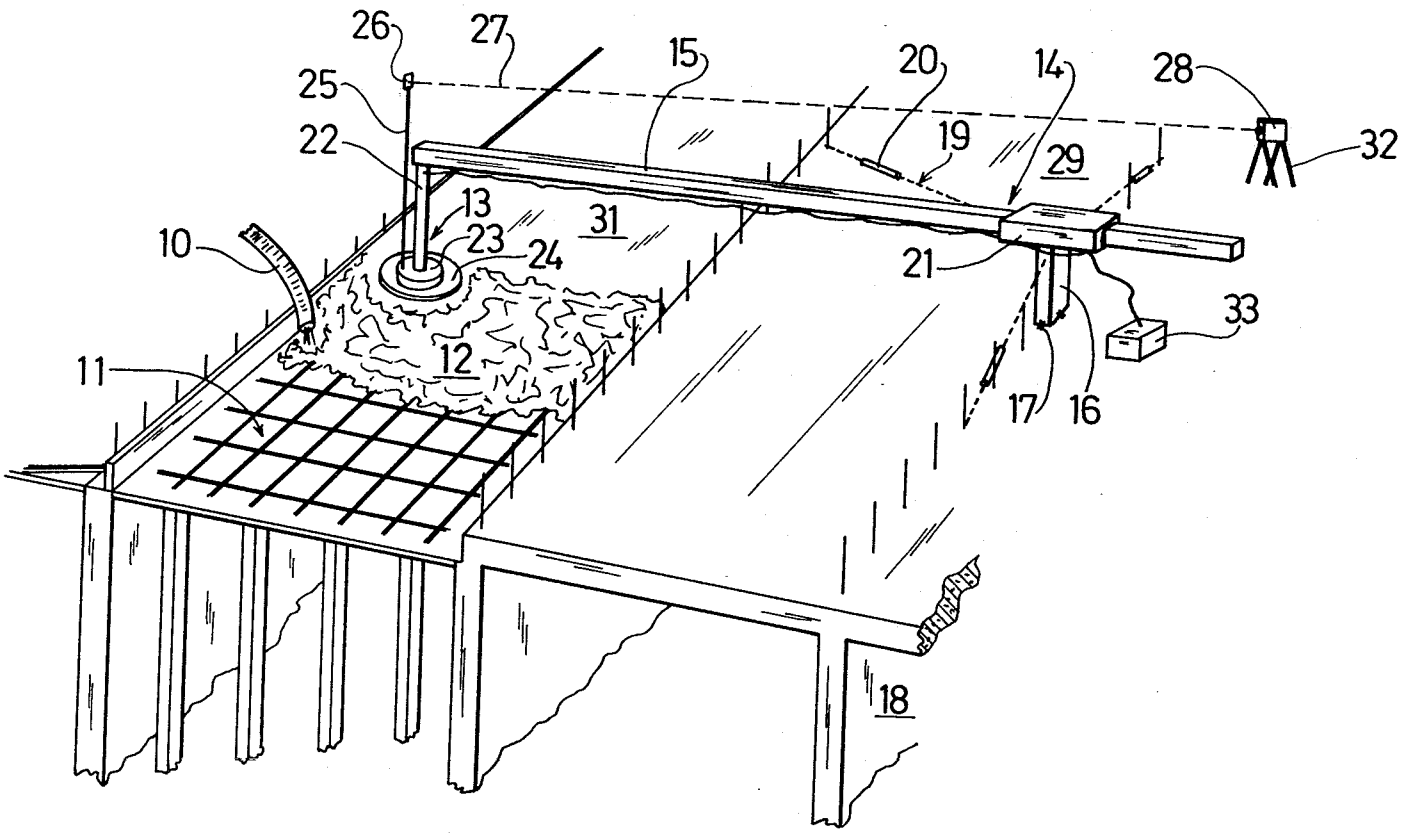
FIG. 1 shows an embodiment of the invention as used for preparing the flooring of a building.

A way of working the invention is illustrated on FIG. 1. An upper flooring of a building is about to be cast, and concrete compound is spread by a transport means 10, a so called concrete pump, into a reinforced formwork 11. The concrete is poker vibrated in a conventional manner by "vibration rods" (not shown in the drawing).The concrete will after such treatment show a very uneven top surface 12, which must be trowelled and smoothed out, so the flooring obtains the desired thickness, as well as a top face, which is plane within prescribed tolerances.

A device for screeding the concrete comprises a trowelling means 13, which is mounted at a carrier 14, erected outside the surface to be treated. The carrier has a cantilever arm 15 pivotably mounted at a pillar 16 so it extends horizontally therefrom. The pillar is in FIG. 1 secured to reinforcing members, or special studs 17, cast into an already erected wall 18 of the building. Adjustable pillar stays 19, preferably including turnbuckles 20, are also attachable to such reinforcing members, or studs. The arm 15 carries the trowelling means 13 at its distal end, and is axially displaceable in a slide 21 at the pillar by any well known device, such as a rack and pinion mechanism. A swinging movement of the arm will also be obtained by well known devices.

The trowelling means 13, the active part of which will be described in detail herebelow, includes a pedestal 22, at the lower end of which a housing 23 is fitted. This housing encloses the driving and supporting means for a rotatable member 24. The pedestal 22 may be shortened or extended so the position of the housing 23 can be vertically adjusted with respect to the point of attachment of the pedestal to the arm 15. Its minimum length should not exceed the height required for the carrier 14 to pass over reinforcing bars projecting from adjacent walls. An upwardly directed measuring rod 25 is attached to housing 23, and is, at its upper end provided with a detector 26 for catching the beam 27 issued by a photo-detector, for instance a laser leveling instrument 28. This is, in use, mounted at a fixed support 29, for instance a flooring, or a wall already erected, and should preferably be arranged so its beam is maintained above those working at the flooring. On occassions it may be required to superelevate the floor, on which occasion the laser beam 27 will have to be slightly tilted.

Figure 2:
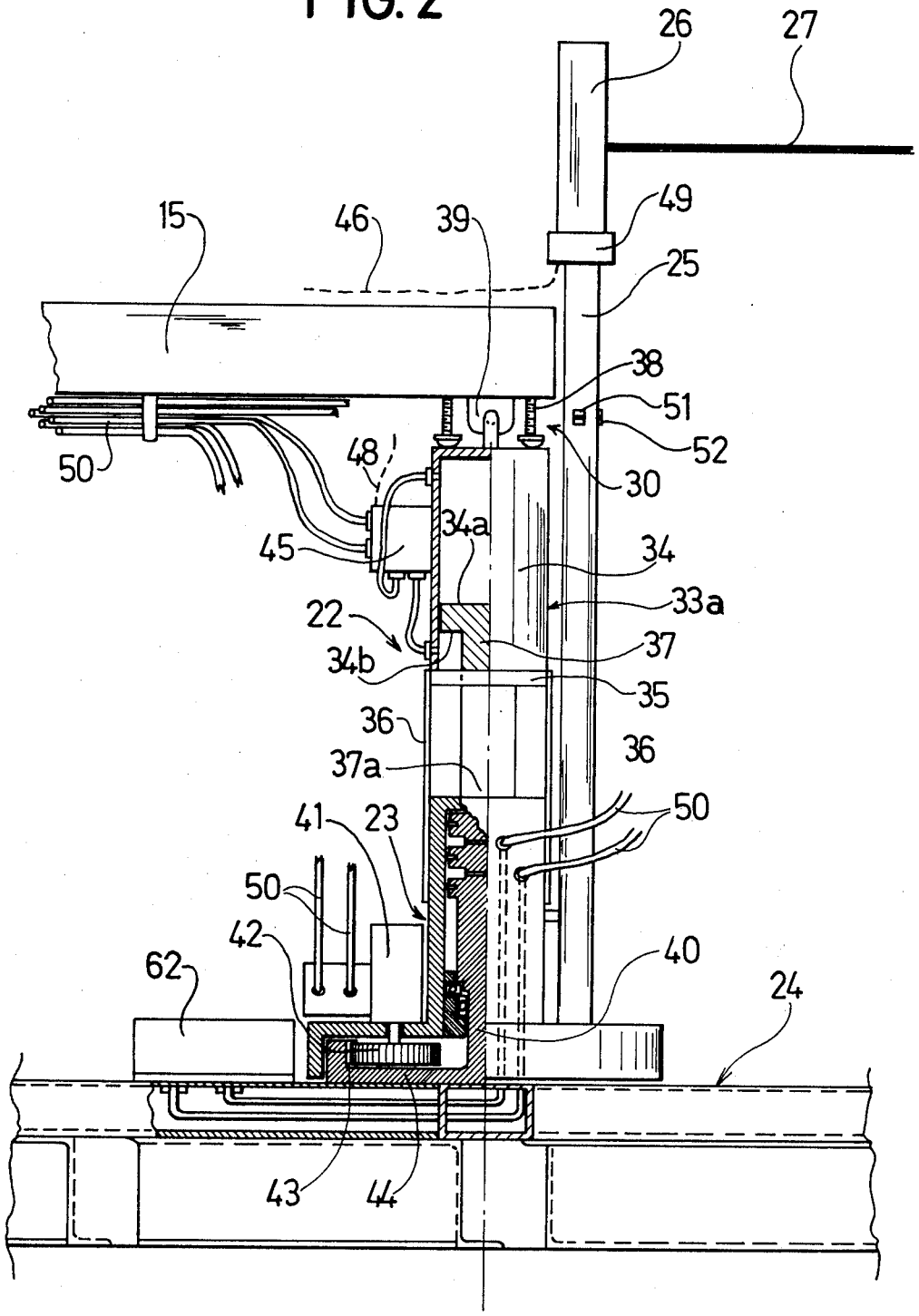
FIG. 2 shows, partly in section, and on a larger scale, the mechanism of the trowelling member.

Before a trowelling operation the pedestal 22 is adjusted into an exact vertical position by means of the stays 19, or by a device 30 provided between the arm 15 and pedestal 22 (see FIG. 2). Then the rotatable member is lowered so its lower edges, which will contact the concrete, obtains the proper height with respect to the desired thickness of the flooring. The laser instrument 28 is adjusted so its beam 27 will be parallel to a plane 31, which is the desired top surface of the flooring, and furthermore so it impinges centrally upon a target at the detector 26 (the position of which is determined by the adjusted rotatable member 24). The trowelling operation can then start by an operator moving the rotatable member 24 over the spread-out concrete. This may be worked along concentric fields if the arm is swung backwards and forwards, and is then axially displaced along parallel fields if the two movements are superimposed upon each other. The laser beam 27 is made to follow the detector by the instrument 28 being swung in relation to the stand 32, upon which it is mounted. The point of contact of the horizontally fixed beam 27 upon detector 26 will in a way well known to a man skilled in the art be transferred into signals governing the height position of rotatable member 24. In this manner the rotatable member will automatically be maintained in the desired plane, deviating therefrom by about ± 1 mm during the whole operation.

The device is preferably provided with hydraulic acatuators fed by a pumping unit 33.

The carrier 14 may be provided with a folding arm, possibly forming part of a mobil or stationary crane, but can also form part of a concrete pump.

FIG. 2 shows the trowelling device more in detail. The pedestal 22 includes a pressure fluid actuated governing mechanism 33*a*, the cylinder 34 of which is attached to a rectangular plate 35. This, in turn, runs in a guide 36, which is attached to the housing 23. The piston 37 of the mechanism is also fixedly connected to housing 23 by way of its piston rod 37*a*. The attachment of the pedestal 22 to the arm 15 preferably includes an adjustment device 30. A simple arrangement is illustrated in the drawing and comprises a number of set screws 38 mounted in the arm and having their heads resting against the flat top face of the pedestal. The screws are arranged at the corners of an imaginary square surrounding pivot means 39 of arbitrary design, and can, by lever action, adjust the position of the pedestal in two planes at right angles to each other. On certain occasions it may be desirable to operate with the pedestal in a slightly oblique position.

A shaft 40, journalled in housing 23, is rotated by means of a hydraulic motor 41, by ways of a gear wheel 42 meshing with an internal gear rim 43, at a lower, sidewardly extended portion 44 of shaft 40.

In use, pressure fluid is supplied to either side 34*a* or 34*b*, respectively, of the piston, depending upon if the laser beam 27, impinges high or low respectively, upon the target of the detector 26. The supply of pressure fluid is guided by a solenoid valve 45, or some similar device in response to signals from the detector. The signals pass from a transmitter 49 at the detector 26 by way of a lead 46, a control unit 47 (FIG. 4), and a further lead 48 to the solenoid valve 45.

Flexible hoses 50 for the various operating functions are connected to the pumping unit 33. Two alignment devices 51, 52, for instance air-bubble levels, are provided at the measuring rod 25, in vertical planes perpendicular to each other, for facilitating the adjustment of the pedestal.

Figure 3:
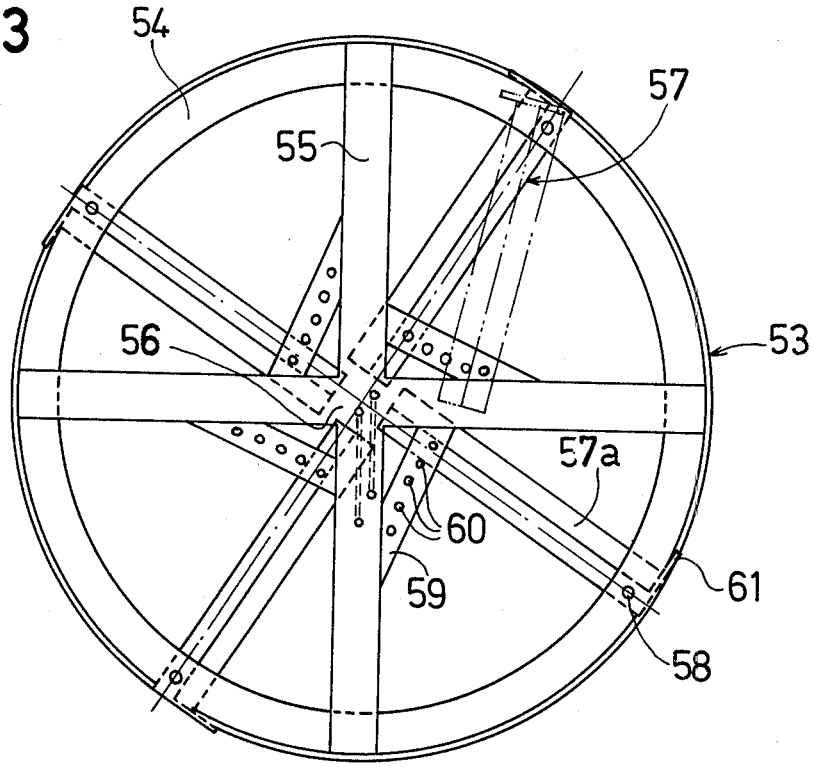
FIG. 3 shows a horizontal section through the concrete contacting parts of the trowelling member.

The main part of the rotatable member 24 is a frame 53 (see also FIG. 3), which is attached to the shaft 40. The frame comprises a ring 54, which is carried by beams 55, arranged like the spokes of a wheel. The hub 56 of the wheel, i.e. the intersection of the beams at the center of the wheel is attached to the shaft 40 by suitable means, not shown. The ring carries at its lower side, a number of scraper blades 57. One end of each scraper blade is mounted at the ring 54 by means of a pivot 58. The inward end of each blade is attachable to a bracket 59 having a number of holes 60. In this manner a blade may be located in different angular positions in relation to diameter lines through the center and its pivot 58.

The scraper blades 57 preferably have a Z-shaped profile, with a lower flange 57*a* pointed in the direction of rotation. In use the concrete surface will be scoured by these flanges, whereby "rollers" of concrete compound will be collected from possible excess material, and will be transported by the blades towards the center of the wheel. The rollers will automatically fill any "dip" in the path covered by the trowelling device. Should too much material collect within the ring, the apparatus will have to be swung to the edge of the floor where the filling operation proceeds.

The angular position of the scraper blades 57 is selected with respect to the consistency of the compound. The outward end of each blade is provided with an end plate 61, which prevents concrete being forced outwards. The compound handled by the trowelling member 24 may be vibrated to prevent the formation of gas bubbles in the trowelled surface. A vibrator 62 is shown in FIG. 2. The rotational speed is comparatively low, about 0.5–1 m/sec at the outward ends of the blades.

Figure 4:
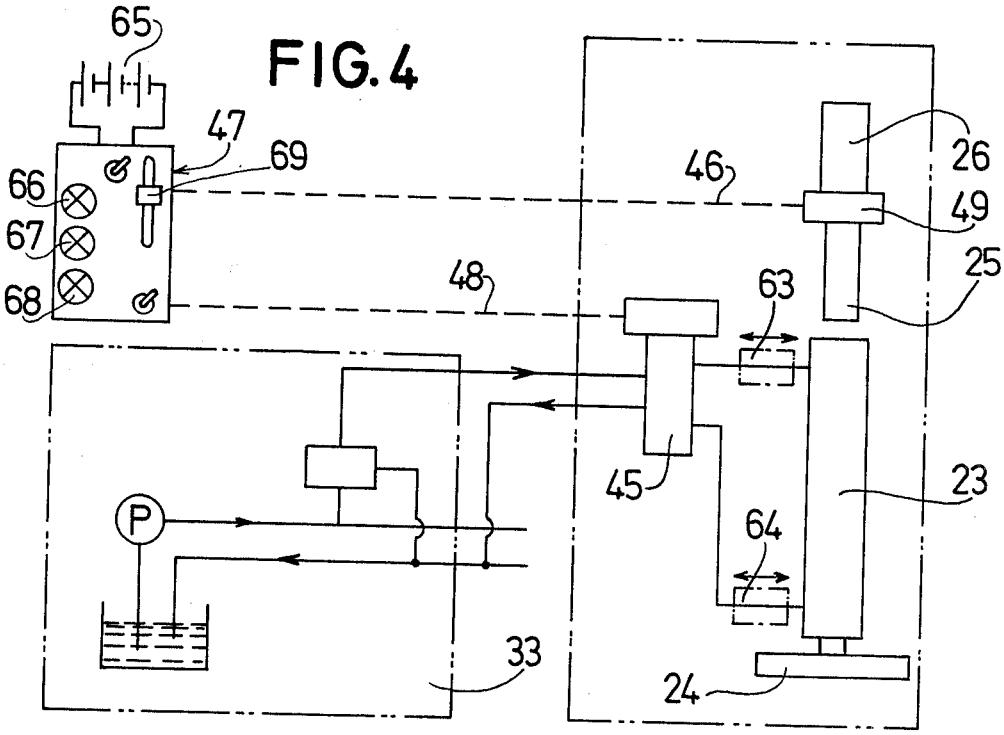
FIG. 4 shows a principal arrangement of the governing means of the device.

FIG. 4 shows the governing system more in detail. The pumping unit 33 is of conventional type, and supplies pressure fluid to the adjusting mechanism 23 by way of the solenoid valve 45, as well as to the driving motor 41 and the vibrator 62. Conventional flow regulating valves are provided between the solenoid valve 45 and the adjusting mechanism 23.

The control unit 47 is connected to a battery 65, which is provided with signal lamps 66–68, indicating "high", "normal" and "low" position, respectively, of the rotatable member 24. The unit is also provided with the necessary switches, and with a means 47 permitting a rough manner pre-setting.

Figure 5:
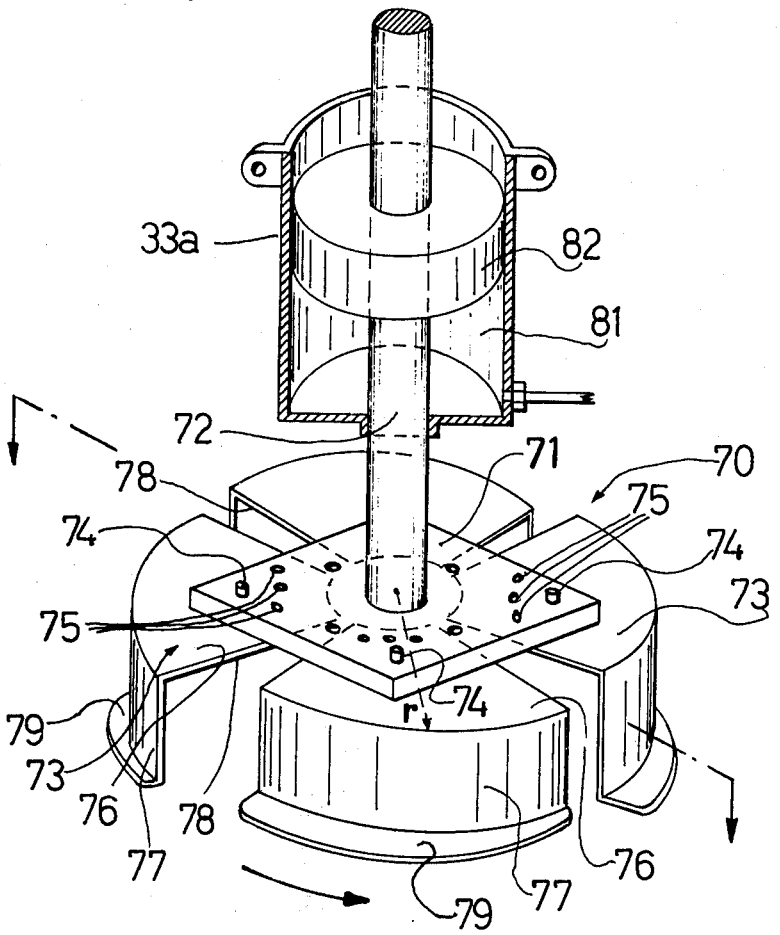
FIG. 5 shows a perspective view of a further embodiment of the trowelling member.
Figure 6:
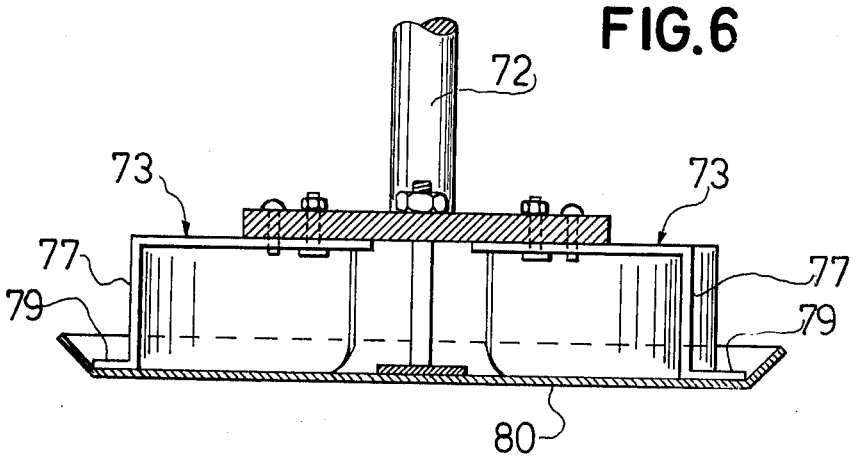
FIG. 6 shows a section therethrough, illustrating a finishing treatment attachment.

A modification of the rotatable member and its adjusting mechanism is schematically illustrated in FIGS. 5 and 6.

The rotatable member here comprises a housing 70, including a base plate 71 attached to the lower end of a shaft 72 forming part of the governing mechanism (33*a*) attachable to the carrier arm. Four sector-shaped shovels 73 are fitted to the plate 71 by means of pivots 74. In the same way as described with the previous embodiment the angular position of the shovels may be adjusted by their inward ends being fixed at a hole 75 in a row of holes provided in plate 71.

Each shovel comprises a roof 76 and a peripheral side wall 77, extending downwardly therefrom. The roof and the side wall are arranged in such a manner, that the distance "r" from the center of shaft 72 to the wall will decrease in the direction of rotation, as counted from the leading edge 78 of the shovel.

Evidently each shovel will, during the rotation of the member catch possible excess material and transport it towards the center of the housing in the same manner as described in connection with the previous embodiment.

An outwardly directed, horizontal flange 79 is fitted to the lower edge of each side wall. This flange will scour the concrete surface and leaves a smooth surface.

To provide a very fine surface an after-treatment may be arranged by fitting a plane disc 80 to the lower face of the housing 70. This is then moved over the surface in the same manner as during the trowelling operation, and will leave a so called "floated" surface.

The adjusting mechanism (33*a*) of the disc here includes a cylinder 81 through which shaft 72 passes. A piston 82 is rotatably, but axially non-displaceably fixed at shaft 72 within cylinder 81. Only the lower part of the cylinder is shown, but evidently, supply of pressure fluid on top of, or below the piston, will adjust the vertical position of the housing 70, in the same manner as previously described.

On top of cylinder 81, there is a motor (not shown) for rotating the shaft 72, which it engages by way of an axially sliding clutch, for instance a splined connection.

The two embodiments above described and illustrated in the drawings are examples only the components of which may vary in many ways within the scope of the appended claims.

What I claim is:

1. A device for trowelling a filling compound upon a substantially horizontal surface, such as a floor, and including an apparatus governed by a level sensing photo-detector adapted to issue a substantially horizontal beam at a predetermined height above said surface, the apparatus comprising a carrier, mountable outside the surface and having a cantilever arm extensible over the surface, a vertical pedestal at the distal end of said cantilever arm for carrying a trowelling means, which includes a compound distributor, as well as means for rotating the same about the pedestal, a mechanism for adjusting said distributor vertically with respect to said pedestal a measuring rod extending upwardly from said trowelling means, and carrying a receiver for the beam issued by said photo-detector, and means for transferring changes in the relative position between said receiver at the measuring rod and said photo-detector beam into signals governing the adjusting mechanism.

2. The device according to claim 1 in which said rotatable trowelling means comprises a ring carried by spokes from a hub, and mounting a number of substantially radially directed scraper blades.

3. The device according to claim 2 in which each scraper blade is mounted by a pivot at said ring, and its end directed towards the hub is adapted to be fixed in different angular positions in relation to a diameter line passing through its pivot at the ring.

4. The device according to claim 1 in which said pedestal is mounted at said carrier by means, which permit adjustment in two vertical planes at right angles to each other.

5. The device according to claim 1 which said trowelling means includes a housing comprising a number of radially directed shovels, each having a roof part and a peripheral wall, said roof and said side wall being so arranged that the radial distance (r) from the pedestal axis to said side wall decreases in the direction of rotation, counting from the leading edge of the shovel.

6. The device according to claim 5 further including horizontal flange members directed outwardly from the lower edges of said side walls.

7. The device according to claim 5 in which said shovels being pivotably fitted at a plate attached to the lower end of said pedestal.

8. The device according to claim 1 in which the rotatable trowelling means is connected to a device for causing vibrations.

* * * * *